US012774568B2

(12) United States Patent
Ljungberg et al.

(10) Patent No.: US 12,774,568 B2
(45) Date of Patent: Oct. 27, 2026

(54) EJECTION ELEMENT, FORMING MOULD COMPRISING AN EJECTION ELEMENT AND METHOD FOR FORMING CELLULOSE PRODUCTS

(71) Applicant: PULPAC AB, Västra Frölunda (SE)

(72) Inventors: Martin Ljungberg, Gothenburg (SE); Olle Högblom, Gothenburg (SE); Björn Arlerot, Gothenburg (SE); Mathias Bergfjord, Gothenburg (SE); Felix Sjöstrand Jonsson, Gothenburg (SE); Niklas Ekstrand, Lerum (SE)

(73) Assignee: PULPAC AB, Västra Frölunda (SE)

( * ) Notice: Subject to any disclaimer, the term of this patent is extended or adjusted under 35 U.S.C. 154(b) by 115 days.

(21) Appl. No.: 18/875,467

(22) PCT Filed: Jun. 16, 2023

(86) PCT No.: PCT/EP2023/066248

§ 371 (c)(1),
(2) Date: Dec. 16, 2024

(87) PCT Pub. No.: WO2023/242402

PCT Pub. Date: Dec. 21, 2023

(65) Prior Publication Data

US 2025/0369194 A1 Dec. 4, 2025

(30) Foreign Application Priority Data

Jun. 17, 2022 (SE) ..... 2250741-2

(51) Int. Cl.
*D21J 3/10* (2006.01)

(52) U.S. Cl.
CPC ..... *D21J 3/10* (2013.01)

(58) Field of Classification Search
CPC ..... D21J 3/10
(Continued)

(56) References Cited

U.S. PATENT DOCUMENTS 4,802,948 A 2/1989 Zimmermann et al.

FOREIGN PATENT DOCUMENTS

EP 3992360 A1 5/2022
JP S60193347 A 10/1985
(Continued)

OTHER PUBLICATIONS

International Search Report and Written Opinion mailed Oct. 17, 2023 for International Application No. PCT/EP2023/066248, 12 pages.

(Continued)

*Primary Examiner* — Jacob T Minskey
(74) *Attorney, Agent, or Firm* — Sage Patent Group

(57) ABSTRACT

An ejection element attached to a forming mould for forming three-dimensional cellulose products from an air-formed cellulose blank structure. The ejection element is arranged for ejecting the cellulose products and/or residual parts of the cellulose blank structure from the forming mould after forming of the cellulose products in the forming mould. The ejection element is arranged as a resilient protruding body extending in a pressing direction of the forming mould relative to a surrounding surface of the forming mould in a non-compressed state. The ejection element is configured for separating the formed cellulose products and/or the residual parts of the cellulose blank structure from the forming mould upon expansion of the ejection element from a compressed state to the non-compressed state after the forming of the cellulose products in the forming mould.

12 Claims, 11 Drawing Sheets

(58) Field of Classification Search
USPC ..... 162/227
See application file for complete search history.

(56) References Cited

FOREIGN PATENT DOCUMENTS

| | | | |
|---|---|---|---|
| JP | H0261170 | A | 3/1990 |
| JP | 2005349578 | A | 12/2005 |
| KR | 20180001271 | U | 5/2018 |

OTHER PUBLICATIONS

International Preliminary Report on Patentability mailed Jun. 4, 2024 for International Application No. PCT/EP2023/066248, 19 pages.

EJECTION ELEMENT, FORMING MOULD COMPRISING AN EJECTION ELEMENT AND METHOD FOR FORMING CELLULOSE PRODUCTS

CROSS-REFERENCE TO RELATED APPLICATIONS

This application is a 35 U.S.C. § 371 national stage application for International Application No. PCT/EP2023/066248, entitled "EJECTION ELEMENT, FORMING MOULD COMPRISING AN EJECTION ELEMENT AND METHOD FOR FORMING CELLULOSE PRODUCTS", filed on Jun. 16, 2023, which claims priority to Swedish Patent Application No. 2250741-2, filed on Jun. 17, 2022, the disclosures and contents of which are hereby incorporated by reference in their entireties.

TECHNICAL FIELD

The present disclosure relates to an ejection element attached to a forming mould for forming three-dimensional cellulose products from an air-formed cellulose blank structure. The disclosure further relates to a forming mould for forming three-dimensional cellulose products from an air-formed cellulose blank structure where the forming mould comprises an ejection element, and a method for forming three-dimensional cellulose products from an air-formed cellulose blank structure in a forming mould where the forming mould comprises an ejection element.

BACKGROUND

Cellulose fibres are commonly used as raw material for producing or manufacturing products. Products formed of cellulose fibres can be used in many different situations where there is a need for sustainable products. A wide range of products can be produced from cellulose fibres and a few examples are disposable plates and cups, cutlery, lids, bottle caps, coffee pods, blank structures, and packaging materials.

Forming mould systems are commonly used when manufacturing cellulose products from raw materials including cellulose fibres, and traditionally the cellulose products have been produced by wet-forming methods. A material commonly used for wet-forming cellulose fibre products is wet moulded pulp. Wet-formed products are generally formed by immersing a suction forming mould into a liquid or semi liquid pulp suspension or slurry comprising cellulose fibres, and when suction is applied, a body of pulp is formed with the shape of the desired product by fibre deposition onto the forming mould. With all wet-forming methods, there is a need for drying of the wet moulded product, where the drying process is a time and energy consuming part of the production. The demands on aesthetical, chemical and mechanical properties of cellulose products are increasing, and due to the properties of wet-formed cellulose products, the mechanical strength, flexibility, freedom in material thickness, and chemical properties are limited. It is also difficult in wet-forming processes to control the mechanical properties of the products with high precision.

One development in the field of producing cellulose products is dry-forming of cellulose products without using wet-forming methods. Instead of forming the cellulose products from a liquid or semi liquid pulp suspension or slurry, an air-formed cellulose blank structure is used. The air-formed cellulose blank structure is inserted into a forming mould and during the dry-forming of the cellulose products, the cellulose blank is subjected to a high forming pressure and a high forming temperature. One difficulty with dry-forming methods is the problem with removing the formed cellulose product from the forming mould in an efficient way. The formed cellulose products are easily stuck onto mould parts of the forming mould after the forming process and therefore many times, mechanical removing devices are used for removing the cellulose products. These mechanical removal devices are costly and complex in design and construction. The removal of the cellulose products is further a time consuming and complicated operation, and there is thus a need for a more efficient and simple forming mould and method.

SUMMARY

An object of the present disclosure is to provide an ejection element, a forming mould, and a method for forming three-dimensional cellulose products, where the previously mentioned problems are avoided. This object is at least partly achieved by the features of the independent claims. The dependent claims contain further developments of the ejection element, forming mould, and method.

The disclosure concerns an ejection element attached to a forming mould for forming three-dimensional cellulose products from an air-formed cellulose blank structure. The ejection element is arranged for ejecting the cellulose products and/or residual parts of the cellulose blank structure from the forming mould after forming of the cellulose products in the forming mould. The ejection element is arranged as a resilient protruding body extending in a pressing direction of the forming mould relative to a surrounding surface of the forming mould in a non-compressed state. The ejection element is configured for separating the formed cellulose products and/or the residual parts of the cellulose blank structure from the forming mould upon expansion of the ejection element from a compressed state to the non-compressed state after the forming of the cellulose products in the forming mould.

Advantages with these features are that the formed cellulose products are efficiently removed from the forming mould with the ejection element. The ejection element is preventing the formed cellulose products from being stuck in the forming mould after the forming process and with the ejection element and there is no need for costly and complex mechanical removing devices for removing the cellulose products. The ejection element is further providing a fast and efficient removal operation and the forming mould can be made simple in construction.

In one embodiment, the ejection element comprises an embossing pattern configured for forming a structural pattern in the cellulose products upon forming in the forming mould. The embossing pattern is efficiently providing the cellulose products with graphical elements during the forming process, and the graphical elements may for example be used for information or marking purposes, or for making the cellulose products attractive.

In one embodiment, the embossing pattern is configured as a logotype, a barcode, a QR code, or other identification code.

The disclosure further concerns a forming mould for forming three-dimensional cellulose products from an air-formed cellulose blank structure. The forming mould comprises at least one ejection element arranged for ejecting the cellulose products and/or residual parts of the cellulose blank structure from the forming mould after forming of the cellulose products in the forming mould. The at least one ejection element is arranged as a resilient protruding body extending in a pressing direction of the forming mould relative to a surrounding surface of the forming mould in a non-compressed state. The at least one ejection element is configured for separating the formed cellulose products and/or residual parts of the cellulose blank structure from the forming mould upon expansion of the at least one ejection element from a compressed state to the non-compressed state after the forming of the cellulose products in the forming mould. An advantage with the construction of the forming mould is that the formed cellulose products are efficiently removed from the forming mould with the ejection elements. The ejection elements are preventing the formed cellulose products from being stuck in the forming mould after the forming process, and the ejection elements are further providing a fast and efficient removal operation of the cellulose products from the forming mould.

In one embodiment, the at least one ejection element is attached to the forming mould. Each ejection element is suitably arranged as a structural part attached to the forming mould. With this construction of the forming mould, each ejection element is arranged as a piece of material that is securely attached to the forming mould for a simple and reliable design.

In one embodiment, the forming mould comprises a first mould part and a second mould part, where the first mould part and the second mould part are movable relative to each other in the pressing direction and arranged to be pressed in relation to each other during forming of the cellulose products. The at least one ejection element is attached to the first mould part and/or the second mould part. It is thus possible to arrange ejection elements on the first mould part or on the second mould part, or alternatively on both mould parts, for an efficient removal of the formed cellulose products and/or residual parts of the cellulose blank structure from the forming mould.

In one embodiment, the first mould part and/or the second mould part comprises a cutting edge configured for cutting out the formed cellulose products from the cellulose blank structure upon forming of the cellulose products in the forming mould. The at least one ejection element is arranged in connection to the cutting edge. By arranging the ejection elements in connection to the cutting edge it is secured that the cellulose products are not stuck onto the cutting edge after a cutting operation. The ejection elements are efficiently pushing the formed cellulose products in a direction away from the cutting edge.

In one embodiment, the at least one ejection element is arranged on a lateral inner side of the cutting edge and configured for separating the formed cellulose products from the forming mould upon expansion of the at least one ejection element from the compressed state to the non-compressed state. By arranging the ejection elements on a lateral inner side of the cutting edge, the cellulose products are efficiently pushed away from the cutting edge.

In one embodiment, the at least one ejection element is arranged on a lateral outer side of the cutting edge and configured for separating residual parts of the cellulose blank structure from the forming mould upon expansion of the at least one ejection element from the compressed state to the non-compressed state. By arranging the ejection elements on a lateral outer side of the cutting edge, the residual parts of the cellulose blank structure are efficiently pushed away from the cutting edge.

In one embodiment, the at least one ejection element is arranged in a cavity in the first mould part and/or the second mould part. The at least one ejection element is in the non-compressed state extending out from the cavity in the pressing direction. The ejection element is configured for being deformed within the cavity in the compressed state. The arrangement of an ejection element in a cavity is securing that the ejection element in the compressed state is not negatively impacting the forming of the cellulose products. The ejection element is free to deform within the cavity without exerting too high pressure onto the cellulose blank structure during the forming operation.

In one embodiment, the at least one ejection element comprises an embossing pattern, and/or wherein the first mould part and/or the second mould part comprises a mould embossing pattern. The embossing pattern and/or mould embossing pattern is configured for forming a structural pattern in the cellulose products upon forming in the forming mould. The embossing pattern and/or mould embossing pattern is efficiently providing the cellulose products with graphical elements during the forming process, and the graphical elements may for example be used for information or marking purposes, or for making the formed products attractive.

In one embodiment, the embossing pattern and/or the mould embossing pattern is configured as a logotype, a barcode, a QR code, or other identification code.

The disclosure further concerns a method for forming three-dimensional cellulose products from an air-formed cellulose blank structure in a forming mould. The forming mould comprises at least one ejection element, where the at least one ejection element is arranged for ejecting the cellulose products and/or residual parts of the cellulose blank structure from the forming mould after forming of the cellulose products in the forming mould. The at least one ejection element is arranged as a resilient protruding body extending in a pressing direction of the forming mould relative to a surrounding surface of the forming mould in a non-compressed state. The method comprises the steps: separating the formed cellulose products and/or residual parts of the cellulose blank structure from the forming mould by the at least one ejection element upon expansion of the at least one ejection element from a compressed state to the non-compressed state after the forming of the cellulose products in the forming mould. The method is providing a way for efficiently removing the formed cellulose products from the forming mould with the ejection element. The ejection element is preventing the formed cellulose products from being stuck in the forming mould. The expansion of the ejection element from the compressed state to the non-compressed state is enabling the ejection element to push the formed cellulose product in a direction away from the forming mould for an easy removal of the cellulose products from the forming mould. The cellulose products are suitably formed as three-dimensional product structures formed from a compressed air-formed cellulose blank structure comprising loose and separated cellulose fibres. With loose and separated cellulose fibres is meant cellulose fibres that are separated from each other and loosely arranged relative to each other within the cellulose blank structure, or cellulose fibres or cellulose fibre bundles that are separated from each other and loosely arranged relative to each other within the cellulose blank structure.

In one embodiment, the forming mould comprises a first mould part and a second mould part, where the first mould part and the second mould part are movable relative to each other in the pressing direction and arranged to be pressed in relation to each other during forming of the cellulose products. The at least one ejection element is attached to the first mould part and/or the second mould part. The method further comprises the steps: separating the formed cellulose products and/or residual parts of the cellulose blank structure from the first mould part and/or the second mould part by the at least one ejection element upon expansion of the at least one ejection element from the compressed state to the non-compressed state after the forming of the cellulose products in the forming mould. The ejection elements could be arranged on the first mould part or on the second mould part, or alternatively on both mould parts, for an efficient removal of the formed cellulose products and/or residual parts of the cellulose blank structure from the forming mould.

In one embodiment, the at least one ejection element comprises an embossing pattern, and/or the first mould part and/or the second mould part comprises a mould embossing pattern. The method further comprises the step: forming a structural pattern in the cellulose products with the embossing pattern and/or the mould embossing pattern upon forming in the forming mould. The embossing pattern and/or mould embossing pattern is efficiently providing the cellulose products with graphical elements during the forming process, and the graphical elements may for example be used for information or marking purposes, or for making the formed cellulose products attractive.

In one embodiment, the embossing pattern and/or the mould embossing pattern is configured as a logotype, a barcode, a QR code, or other identification code.

In one embodiment, the first mould part and/or the second mould part comprises a cutting edge configured for cutting out the formed cellulose products from the cellulose blank structure upon forming of the cellulose products in the forming mould. The at least one ejection element is arranged in connection to the cutting edge on a lateral inner side of the cutting edge. The method further comprises the step: separating the formed cellulose products from the forming mould by the at least one ejection element upon expansion of the at least one ejection element from the compressed state to the non-compressed state. By arranging the ejection element on a lateral inner side of the cutting edge, the cellulose products are efficiently pushed away from the cutting edge.

In one embodiment, the first mould part and/or the second mould part comprises a cutting edge configured for cutting out the formed cellulose products from the cellulose blank structure upon forming of the cellulose products in the forming mould. The at least one ejection element is arranged in connection to the cutting edge on a lateral outer side of the cutting edge. The method further comprises the step: separating residual parts of the cellulose blank structure from the forming mould by the at least one ejection element upon expansion of the at least one ejection element from the compressed state to the non-compressed state. By arranging the ejection element on a lateral outer side of the cutting edge, the residual parts of the cellulose blank structure are efficiently pushed away from the cutting edge.

In one embodiment, the at least one ejection element is arranged in a cavity in the first mould part and/or the second mould part. The at least one ejection element is in the non-compressed state extending out from the cavity in the pressing direction. The method further comprises the step: deforming the ejection element within the cavity in the compressed state. The arrangement of the ejection elements in a cavity is securing that the ejection elements in the compressed state is not negatively impacting the forming of the cellulose products. The ejection element is free to deform within the cavity without exerting too high pressure onto the cellulose blank structure during the forming operation.

BRIEF DESCRIPTION OF DRAWINGS

The disclosure will be described in detail in the following, with reference to the attached drawings, in which.

DESCRIPTION OF EXAMPLE EMBODIMENTS

Various aspects of the disclosure will hereinafter be described in conjunction with the appended drawings to illustrate and not to limit the disclosure, wherein like designations denote like elements, and variations of the described aspects are not restricted to the specifically shown embodiments, but are applicable on other variations of the disclosure.

Figure 1A:
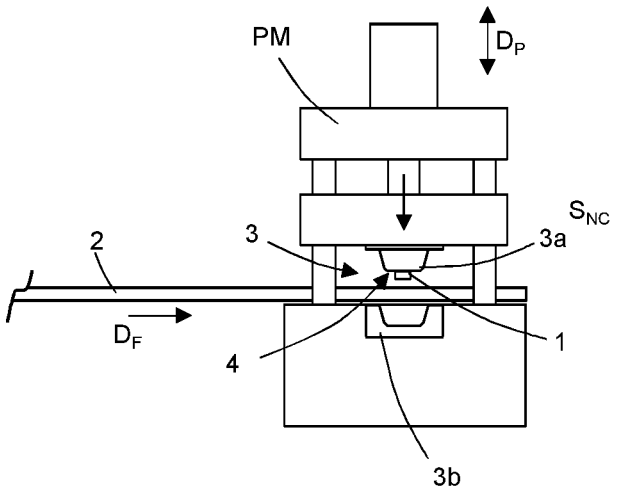
FIG. 1*a-c* show schematically, in side views, a pressing module with a forming mould comprising an ejection element according to an embodiment.
Figure 1B:
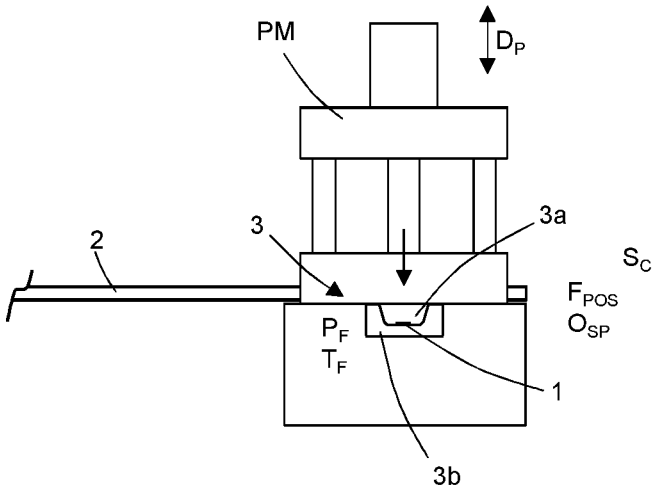
Figure 1C:
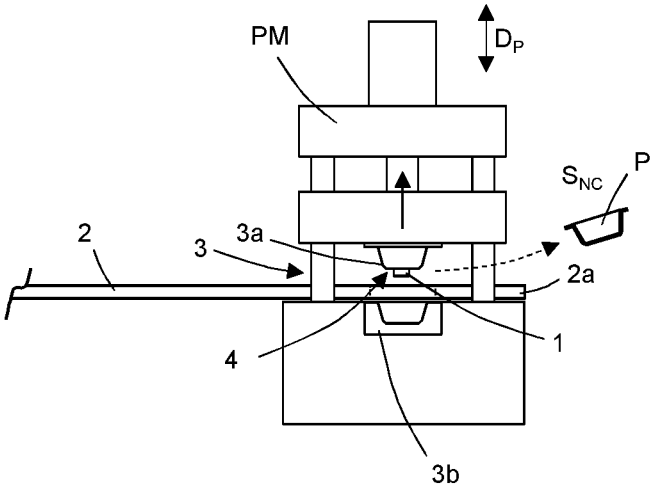

FIGS. 1*a-c* schematically show a pressing module PM for dry-forming cellulose products P from an air-formed cellulose blank structure 2. The pressing module PM comprises a forming mould 3. The forming mould 3 is arranged with a first mould part 3*a* and a second mould part 3*b* configured for interacting with each other for forming the cellulose products P from the air-formed cellulose blank structure 2 in the forming mould 3. The first mould part 3*a* and/or the second mould part 3*b* are movably arranged relative to each other in a pressing direction $D_P$. In the illustrated embodiment, an ejection element 1 is attached to the forming mould 3.

The ejection element 1 is arranged for ejecting the cellulose products P and/or residual parts 2*a* of the cellulose blank structure 2 from the forming mould 3, after forming of the cellulose products P in the forming mould 3, as will be further described below.

The cellulose products P are dry-formed from the air-formed cellulose blank structure 2 in the pressing module PM. With an air-formed cellulose blank structure 2 is meant an essentially air-formed fibrous web structure produced from cellulose fibres, where the cellulose fibres are carried and formed to the cellulose blank structure 2 by air as carrying medium. The cellulose blank structure 2 comprises loose and separated cellulose fibres that are compressed upon forming of the cellulose products P. With loose and separated cellulose fibres is meant cellulose fibres that are separated from each other and loosely arranged relative to each other within the cellulose blank structure 2, or cellulose fibres or cellulose fibre bundles that are separated from each other and loosely arranged relative to each other within the cellulose blank structure 2. The cellulose fibres may originate from a suitable cellulose raw material, such as a pulp material. Suitable pulp materials are for example fluff pulp, paper structures, or other cellulose fibre containing structures. The cellulose fibres may also be extracted from agricultural waste materials, for example wheat straws, fruit and vegetable peels, bagasse, or from other suitable sources. When for example using pulp as raw material for the cellulose blank structure 2, the pulp structure commonly needs to be separated in a separating unit, such as a suitable mill unit, before the air-forming of the cellulose blank structure 2. In the separating unit, the pulp structure is separated into individual cellulose fibres, or into individual cellulose fibres and cellulose fibre bundles, and the better milling process the more individual cellulose fibres are formed. In other embodiments, only individual cellulose fibres may be used as raw material for the cellulose blank structure 2. With air-forming of the cellulose blank structure 2 is meant the formation of a cellulose blank structure in a dry and controlled fibre forming process in which the cellulose fibres are air-formed to produce the cellulose blank structure 2. When forming the cellulose blank structure 2 in the air-forming process, the cellulose fibres are carried and formed to the cellulose blank structure 2 by air as carrying medium. It should be understood that even if the cellulose blank structure 2 is slightly compacted before the forming of the cellulose products P, such as compacting the cellulose blank structure 2 for feeding or transportation purposes, the cellulose blank structure 2 still comprises loose and separated cellulose fibres.

The air-forming process for forming the cellulose blank structure 2 is different from a normal papermaking process or a traditional wet-forming process, where water is used as carrying medium for the cellulose fibres when forming the paper or fibre structure. In the air-forming process, small amounts of water or other substances may if desired be added to the cellulose fibres in order to change the properties of the cellulose products, but air is still used as carrying medium in the forming process. The cellulose blank structure 2 may, if suitable have a dryness that is mainly corresponding to the ambient humidity in the atmosphere surrounding the air-formed cellulose blank structure 2. As an alternative, the dryness of the cellulose blank structure 2 can be controlled in order to have a suitable dryness level when forming the cellulose products P.

The air-formed cellulose blank structure 2 may be formed of cellulose fibres in a conventional air-forming process or in a cellulose blank air-forming module. The cellulose blank structure 2 may have a composition where the fibres are of the same origin or alternatively contain a mix of two or more types of cellulose fibres, depending on the desired properties of the cellulose products P. The cellulose fibres used in the cellulose blank structure 2 are during the forming process of the cellulose products P strongly bonded to each other with hydrogen bonds, due to applied forming pressure and forming temperature together with adequate moist content in the cellulose blank structure 2. The cellulose fibres may be mixed with other substances or compounds to a certain amount as will be further described below. With cellulose fibres is meant any type of cellulose fibres, such as natural cellulose fibres or manufactured cellulose fibres. The cellulose blank structure 2 may specifically comprise at least 95% cellulose fibres, or more specifically at least 99% cellulose fibres.

The air-formed cellulose blank structure 2 may have a single-layer or a multi-layer configuration. A cellulose blank structure 2 having a single-layer configuration is referring to a structure that is formed of one layer containing cellulose fibres. A cellulose blank structure 2 having a multi-layer configuration is referring to a structure that is formed of two or more layers comprising cellulose fibres, where the layers may have the same or different compositions or configurations.

The cellulose blank structure 2 may comprise one or more additional cellulose layers comprising cellulose fibres, where an additional cellulose layer for example is arranged as a carrying layer for one or more other layers of the cellulose blank structure 2. The one or more additional cellulose layers may act as reinforcement layers having a higher tensile strength than other layers of the cellulose blank structure 2. This is useful when one or more air-formed layers of the cellulose blank structure 2 have compositions with low tensile strength in order to avoid that the cellulose blank structure 2 will break during the forming of the cellulose products P. The one or more additional cellulose layers with higher tensile strength act in this way as a supporting structure for other layers of the cellulose blank structure 2. The one or more additional cellulose layers may be of a different composition than the rest of the cellulose blank structure 2, such as for example a tissue layer containing cellulose fibres, an airlaid structure comprising cellulose fibres, or other suitable layer structures. It is thus not necessary that the one or more additional cellulose layers are air-formed. Other suitable additional layers may also be used such as for example silicone coated structures or bio-based films.

The one or more air-formed layers of the cellulose blank structure 2 are fluffy and airy structures, where the cellulose fibres forming the structures are arranged relatively loosely relative to each other. The fluffy cellulose blank structures 2 are used for an efficient dry-forming of the cellulose products P, allowing the cellulose fibres to form the cellulose products P in an efficient way during the dry-forming process in the pressing module PM.

FIGS. 1*a-c* schematically show an example embodiment of the pressing module PM for dry-forming cellulose products P from the cellulose blank structure 2. To form the cellulose products P from the air-formed cellulose blank structure 2 in the pressing module PM, the cellulose blank structure 2 is first provided from a suitable source. The cellulose blank structure 2 may be air-formed from cellulose fibres and arranged on rolls or in stacks. The rolls or stacks may thereafter be arranged in connection to the pressing module PM. As an alternative, the cellulose blank structure 2 may be air-formed from cellulose fibres in a non-illustrated cellulose blank air-forming module arranged in connection to the pressing module PM, and directly fed to the pressing module PM after the air-forming operation. The cellulose blank structure 2 is fed to the pressing module PM with suitable non-illustrated transportation means, such as forming wires, vacuum belt feeders, or conveyor belts.

The pressing module PM comprises one or more forming moulds 3, and the one or more forming moulds 3 are configured for dry-forming the cellulose products P from the cellulose blank structure 2. The pressing module PM may be arranged with only one forming mould 3 in a single-cavity configuration, or alternatively with two or more forming moulds in a multi-cavity configuration. A single-cavity configuration pressing module thus comprises only one forming mould 3 with a first mould part 3*a* and a cooperating second mould part 3*b*. A multi-cavity configuration pressing module comprises two or more forming moulds 3, each having cooperating first mould part 3*a* and second mould part 3*b*.

In the embodiment illustrated in FIGS. 1*a-c*, the pressing module PM is arranged as a single-cavity configuration pressing module comprising one forming mould 3 with a first mould part 3*a* and a second mould part 3*b* movably arranged relative to each other. In the following, the pressing module PM will be described in connection to a single-cavity configuration pressing module, but the disclosure is equally applicable on a multi-cavity configuration pressing module.

The pressing module PM can for example be constructed so that the first mould part 3*a* or the second mould part 3*b* is movable and arranged to move towards the other mould part during the dry-forming process, where the other mould part is stationary or non-movably arranged. In the embodiment illustrated in FIGS. 1*a-c*, the first mould part 3*a* is movably arranged and the second mould part 3*b* is stationary. In an alternative non-illustrated embodiment, both the first mould part 3*a* and the second mould part 3*b* are movably arranged, where the first mould part 3*a* and the second mould part 3*b* are displaced in directions towards each other during the dry-forming process. The moving mould parts may be displaced with a suitable actuator, such as a hydraulic, pneumatic, or electric actuator. A combination of different actuators may also be used. The relative speed between the first mould part 3*a* and the second mould part 3*b* during the dry-forming process is suitably chosen so that the cellulose blank structure 2 is evenly distributed in the forming mould 3 during the dry-forming process.

As indicated in FIGS. 1*a-c*, the first mould part 3*a* is movably arranged relative to the second mould part 3*b* in the pressing direction $D_P$ and the first mould part 3*a* is further arranged to be pressed towards the second mould part 3*b* in the pressing direction $D_P$ during dry-forming of the cellulose products P for establishing a forming pressure $P_F$ onto the cellulose blank structure 2. When dry-forming the cellulose products P, the cellulose blank structure 2 is arranged between the first mould part 3*a* and the second mould part 3*b* when the forming mould 3 is in an open state, as shown in FIG. 1*a*. When the cellulose blank structure 2 has been arranged in the forming mould 3, the first mould part 3*a* is moved towards the second mould part 3*b* during the dry-forming process. When the forming pressure $P_F$ together with a suitable forming temperature $T_F$ are established in the forming mould 3 onto the cellulose blank structure 2, the movement of the first mould part 3*a* is stopped in a product forming position $F_{POS}$, as shown in FIG. 1*b*. As shown in FIG. 1*c*, the first mould part 3*a* is thereafter moved in a direction away from the second mould part 3*b* after a certain time duration or directly after the first mould part 3*a* has been stopped. A suitable control system may be used for controlling the operation of the pressing module PM and the forming mould 3.

The cellulose products P are dry-formed from the cellulose blank structure 2 in the forming mould 3 by applying the forming pressure $P_F$ and the forming temperature $T_F$ onto the air-formed cellulose blank structure 2. The cellulose blank structure 2 is heated to a forming temperature $T_F$ in the range of 100-300° C., preferably in the range of 100-200° C., and pressed with a forming pressure $P_F$ in the range of 1-100 MPa, preferably in the range of 4-20 MPa. The first mould part 3*a* is arranged for forming the cellulose products P through interaction with the corresponding second mould part 3*b*. During dry-forming of the cellulose products P, the air-formed cellulose blank structure 2 is arranged in the forming mould 3, between the first mould part 3*a* and the second mould part 3*b*, and exerted to the forming pressure $P_F$ in the range of 1-100 MPa, preferably in the range of 4-20 MPa, and the forming temperature $T_F$ in the range of 100-300° C., preferably in the range of 100-200° C. When dry-forming the cellulose products P, hydrogen bonds are formed between the cellulose fibres in the cellulose blank structure 2 arranged between the first mould part 3*a* and the second mould part 3*b*, due to the applied forming pressure $P_F$ and forming temperature $T_F$ together with adequate moist content in the cellulose blank structure 2.

The temperature and pressure levels are for example measured in the cellulose blank structure 2 during the dry-forming process with suitable sensors arranged in or in connection to the cellulose fibres in the cellulose blank structure 2. The cellulose blank structure 2 is typically containing less than 45 weight percent water when formed in the forming mould 3.

A cellulose product forming cycle is schematically illustrated in FIGS. 1*a-c*. The cellulose blank structure 2 is, as indicated in FIG. 1*a*, transported to the forming mould 3 in a feeding direction $D_F$ with a suitable transportation speed. The cellulose blank structure 2 is suitably fed intermittently to the forming mould 3. In order to form the cellulose products P, the cellulose blank structure 2 is arranged between the first mould part 3*a* and the second mould part 3*b*, as shown in FIG. 1*a*. Upon forming of the cellulose products P, the first mould part 3*a* is moved towards the second mould part 3*b*, and in the illustrated embodiment, the cellulose blank structure 2 is pushed by the first mould part 3*a* into the second mould part 3*b*. When the first mould part 3*a* is pushed towards the second mould part 3*b* with the cellulose blank structure 2 positioned between the mould parts, the forming pressure $P_F$ is established onto the cellulose blank structure 2 by the pushing force applied by the first mould part 3*a*. The interaction between the first mould part 3*a* and the second mould part 3*b* is thus establishing the forming pressure $P_F$ in the forming mould 3. The applied force is during the forming process establishing the forming pressure $P_F$ onto the cellulose blank structure 2, as shown in FIG. 1*b*, which together with the forming temperature $T_F$ applied onto the cellulose blank structure 2 are dry-forming the cellulose products P.

Suitably, the forming pressure $P_F$ is applied onto the air-formed cellulose blank structure 2 during a single pressing operation $O_{SP}$ upon forming of the cellulose products P in the forming mould 3. With a single pressing operation $O_{SP}$ is meant that the cellulose product P is formed from the cellulose blank structure 2 in one single pressing step in the forming mould 3. In the single pressing operation $O_{SP}$, the first mould part 3*a* and the second mould part 3*b* are interacting with each other for establishing the forming pressure $P_F$ and the forming temperature $T_F$ during a single operational engagement step. Thus, in the single pressing operation $O_{SP}$, the forming pressure $P_F$ and the forming temperature $T_F$ are not applied to the cellulose blank structure 2 in two or more repeated pressing steps.

When the cellulose products have been dry-formed in the forming mould 3, the first mould part 3*a* is moved away from the second mould part 3*b*, as shown in FIG. 1*c*, and the formed cellulose product P can be removed from the forming mould 3 with the ejection element 1, as will be further described below. After removal of the cellulose product P, the cellulose product forming cycle is repeated.

For all embodiments, the forming mould 3 comprises at least one ejection element 1 arranged for ejecting the cellulose products P and/or residual parts 2*a* of the cellulose blank structure 2 from the forming mould 3 after forming of the cellulose products P in the forming mould 3. As described above, the forming mould 3 comprises a first mould part 3*a* and a second mould part 3*b*, where the first mould part 3*a* and the second mould part 3*b* are movable relative to each other in the pressing direction $D_P$ and arranged to be pressed in relation to each other during forming of the cellulose products P. The at least one ejection element 1 is attached to the first mould part 3*a* and/or the second mould part 3*b*, and the at least one ejection element 1 is configured for separating the formed cellulose products P and/or residual parts 2*a* of the cellulose blank structure 2 from the first mould part 3*a* and/or the second mould part 3*b* by the at least one ejection element 1 upon expansion of the at least one ejection element 1 from the compressed state $S_C$ to the non-compressed state $S_{NC}$ after the forming of the cellulose products P in the forming mould 3.

The residual parts 2*a* of the cellulose blank structure 2 are remaining structural parts of the cellulose blank structure 2 after forming and separating the cellulose products P from the cellulose blank structure 2. The formed cellulose products P may be separated from the cellulose blank structure 2 by a cutting operation during or after forming of the cellulose products P, and the remaining parts of the cellulose blank structure 2 not forming the cellulose products P are constituting the residual parts 2*a*. The at least one ejection element 1 is arranged as a resilient protruding body extending in the pressing direction $D_P$ of the forming mould 3 relative to a surrounding surface 4 of the forming mould 3 in a non-compressed state $S_{NC}$. The at least one ejection element 1 is configured for separating the formed cellulose products P and/or the residual parts 2*a* of the cellulose blank structure 2 from the forming mould 3 upon expansion of the at least one ejection element 1 from a compressed state $S_C$ to the non-compressed state $S_{NC}$ after the forming of the cellulose products P in the forming mould 3, as will be further described below.

In the embodiment illustrated in FIGS. 1*a-c*, the forming mould 3 comprises one ejection element 1 attached to the first mould part 3*a*, and the ejection element 1 is arranged as a resilient protruding body extending in the pressing direction $D_P$ of the forming mould 3 relative to a surrounding surface 4 of the forming mould 3 in a non-compressed state $S_{NC}$, as shown in FIGS. 1*a* and 1*c*. In this embodiment, the ejection element 1 is centrally arranged on the first mould part 3*a*, and with this configuration the ejection element 1 is arranged for ejecting the cellulose products P from the forming mould 3 after forming of the cellulose products P in the forming mould 3. When dry-forming the cellulose products P in the forming position $F_{POS}$, as shown in FIG. 1*b*, the ejection element 1 is deformed from the non-compressed state $S_{NC}$ shown in FIG. 1*a* to the compressed state $S_C$ shown in FIG. 1*b* due to the forces acting on the mould parts. After dry-forming the cellulose products P in the forming position $F_{POS}$, the first mould part 3*a* is moved in a direction away from the second mould part 3*b*, as indicated with the arrow in FIG. 1*c*, and during this movement the ejection element 1 is expanded from the compressed state $S_C$ back to the non-compressed state $S_{NC}$. Through the expansion from the compressed state $S_C$ back to the non-compressed state $S_{NC}$, the ejection element 1 is separating the formed cellulose products P from the forming mould 3. The expansion of the ejection element 1 from the compressed state $S_C$ back to the non-compressed state $S_{NC}$ is enabling a downwards pushing action by the ejection element 1 onto the formed cellulose product P in a direction away from the first mould part 3*a*. Thereafter, the cellulose products P are easily removed from the forming mould 3, as indicated with the dashed arrow in FIG. 1*c*.

For all embodiments, the forming mould may be arranged with stiff mould parts or alternatively with one or more deformation elements arranged in the mould parts. With stiff mould parts is meant that the mould parts are made of a stiff material with limited deformation capabilities, such as for example steel or aluminium. A deformation element is made of a material that is allowed to deform when forming the cellulose products P in the forming mould 3. The at least one ejection element 1 may be attached both to stiff mould parts or deformation elements, or alternatively be integrated in the deformation elements. For different embodiments, the at least one ejection element 1 may be attached to the first mould part 3*a* and/or the second mould part 3*b* with suitable attachment means, such as mechanical fasteners, glue or other suitable attachment arrangements.

If the forming mould 3 comprises a deformation element, the deformation element is made of a material that can be deformed when a force or pressure is applied, and the deformation element is suitably made of an elastic material capable of recovering size and shape after deformation. If the deformation element is made of such a material, an even pressure distribution can be achieved in the forming process, where the pressure exerted onto the cellulose blank structure 2 from the deformation element is equal or essentially equal in all directions. When the deformation element under pressure is in a fluid-like state, a uniform fluid-like pressure distribution is achieved. The forming pressure $P_F$ is with such a material thus applied to the cellulose blank structure 2 from all directions, and the deformation element may exert an isostatic forming pressure on the cellulose blank structure during the dry-forming of the cellulose products.

The at least one ejection element 1 is suitably arranged as a separate piece of material that is securely attached to the first mould part 3*a* and/or the second mould part 3*b*. The ejection element 1 is configured as a resilient protruding body extending in the pressing direction $D_P$. The ejection element 1 is made of a material that can be deformed when a force or pressure is applied, and the ejection element 1 is suitably made of an elastic material capable of recovering size and shape after deformation. In this way, the ejection element 1 can expand from the compressed state $S_C$ back to the non-compressed state $S_{NC}$ after the forming operation. With such a configuration, the ejection element 1 could be made of any suitable resilient material, such as for example silicone rubber, polyurethane, polychloroprene, or rubber. Other materials for the ejection element 1 may for example be suitable gel materials, liquid crystal elastomers, and MR fluids.

In other embodiments, the at least one ejection element 1 is arranged in a cavity 9 in the first mould part 3*a* and/or the second mould part 3*b*, and the at least one ejection element 1 is in the non-compressed state $S_{NC}$ extending out from the cavity 9 in the pressing direction $D_P$. The ejection element 1 is configured for being deformed within the cavity 9 in the compressed state $S_C$.

Figure 2A:
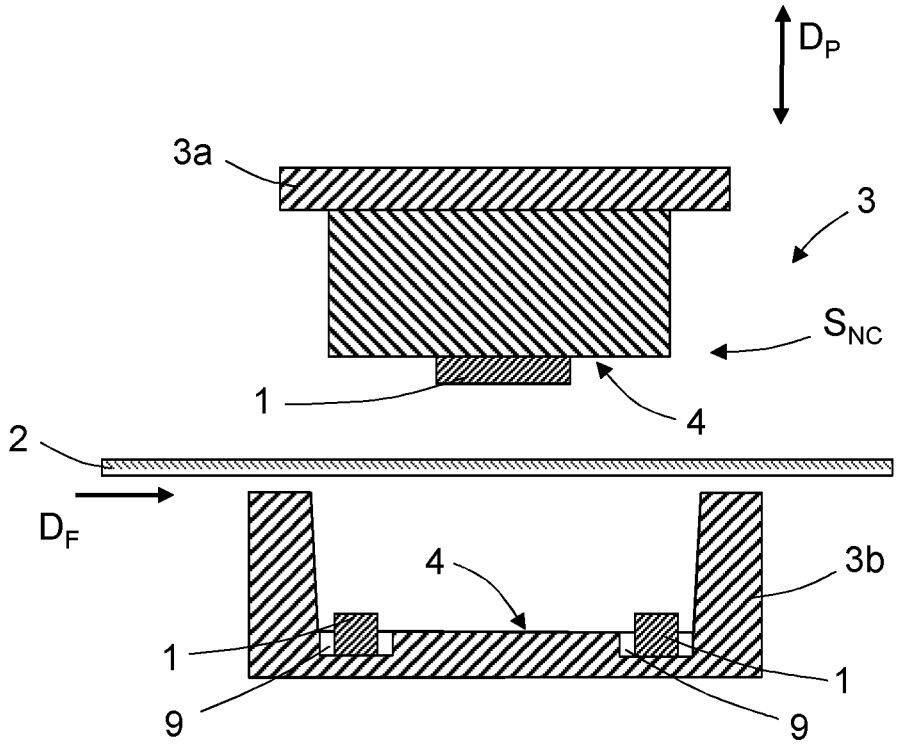
FIG. 2*a-e* show schematically, in side views, a forming mould with ejection elements according to an alternative embodiment.
Figure 2B:
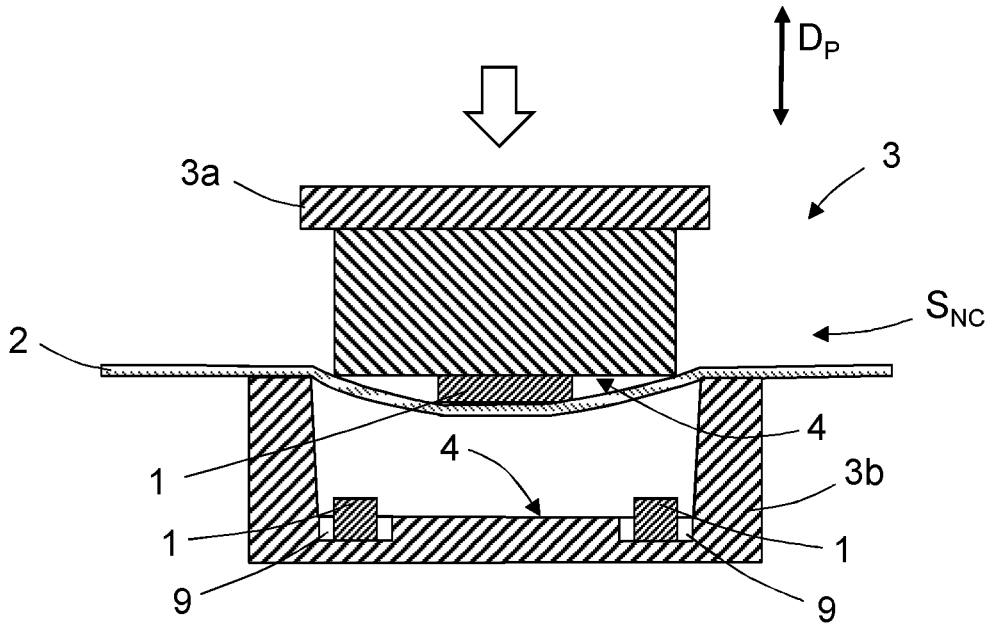
Figure 2C:
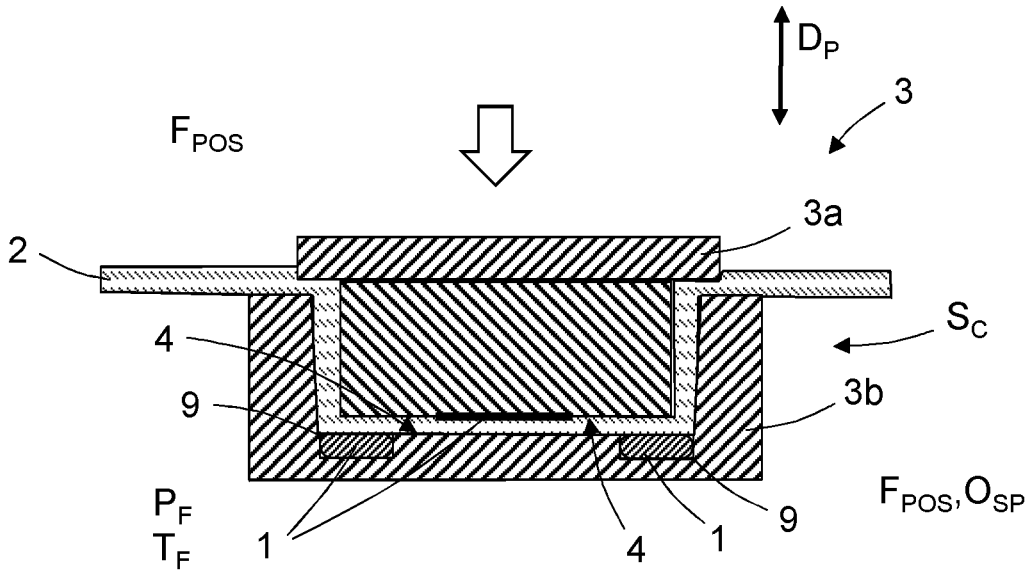

An alternative embodiment of the forming mould 3 is schematically illustrated in FIGS. 2*a-e*. In this embodiment, the first mould part 3*a* comprises an ejection element 1 and the second mould part 3*b* comprises a plurality of ejection elements 1 of which two are shown in the figures. The ejection elements 1 are arranged as resilient protruding bodies extending in the pressing direction $D_P$ of the forming mould 3 relative to a surrounding surface 4 of the forming mould 3 in the non-compressed state $S_{NC}$. The ejection elements of the second mould part 3*b* are each arranged in a cavity 9. In the non-compressed state $S_{NC}$ the ejection elements 1 are extending out from the cavity 9 in the pressing direction $D_P$, as shown in for example FIG. 2*a*, and in the compressed state $S_C$ the ejection elements 1 are deformed within the cavity 9 as shown in FIG. 2*c*. The arrangement of the ejection elements 1 in cavities 9 is securing that the ejection elements 1 in the compressed state are not negatively impacting the forming of the cellulose products P. The ejection elements 1 are free to deform within its cavity without exerting too high pressure onto the cellulose blank structure 2 during the forming operation. It should be understood that each cavity 9 in other non-illustrated embodiments alternatively may be arranged with two or more ejection elements 1.

Specifically, in some example embodiments, the least one ejection element 1 is arranged in a cavity 9 in the second mould part 3*b*, and the corresponding pressing surface of the first mould part 3*a* is flat in the region facing the cavity 9. In some example embodiments, the least one ejection element 1 is arranged in a cavity 9 in the first mould part 3*a*, and the corresponding pressing surface of the second mould part 3*b* is flat in the region facing the cavity 9.

In other words, in some example embodiments, the corresponding pressing surface of the oppositely located mould part 3*a*, 3*b* is arranged to be flush with edges of the cavity in the compressed state. As a result, the depth of the cavity is equal to the height of the ejection element 1 in the compressed state.

Hence, in some example embodiments, the depth of the cavity, together with the length of the ejection element 1 in the non-compressed state $S_{NC}$ that extends out from the cavity 9 in the pressing direction $D_P$ jointly defines the level of compression of the ejection element 1. As a result, the maximal compression level of the ejection element 1 may be determined. Similarly, the maximal pressure level that the ejection elements 1 exert onto the cellulose blank structure 2 during the forming operation may be predetermined.

Furthermore, in some example embodiments, the cavity 9 may be defined by a bottom wall, and one or more side walls extending primarily in the pressing direction $D_P$, wherein the size of the ejection element 1 and the size of the cavity 9 are selected such that the ejection element 1 completely fills the cavity 9 in the compressed state.

In other words, the ejection element 1 may be arranged to be supported on all sides in the cavity 9 in the compressed state. This has the advantage that the form of the ejection element 1 can be better controlled in the compressed state, i.e. have a less uncontrolled deformation shape. This may be specifically important in case the ejection element 1 comprises an embossing pattern 5 configured for forming a structural pattern 7 in the cellulose products P upon forming in the forming mould 3, because the better controlled deformation of the ejection element 1 enables improved structural pattern 7 in the cellulose products P upon forming in the forming mould 3.

The cellulose blank structure 2 is, as indicated in FIG. 2*a*, transported to the forming mould 3 in a feeding direction $D_F$. The cellulose blank structure 2 is suitably fed intermittently to the forming mould 3. In order to form the cellulose products P, the cellulose blank structure 2 is arranged between the first mould part 3*a* and the second mould part 3*b*, as shown in FIG. 2*a*.

Upon forming of the cellulose products P, the first mould part 3*a* is moved towards the second mould part 3*b*, as shown in FIG. 2*b*, and in the illustrated embodiment, the cellulose blank structure 2 is pushed by the first mould part 3*a* with the ejection element 1 into the second mould part 3*b*. When the first mould part 3*a* is pushed towards the second mould part 3*b* with the cellulose blank structure 2 positioned between the mould parts, the forming pressure $P_F$ is established onto the cellulose blank structure 2 by the pushing force applied by the first mould part 3*a*.

Before any forming pressure $P_F$ is exerted onto the cellulose blank structure 2, the ejection elements 1 are arranged in the non-compressed state $S_{NC}$, as schematically illustrated in FIGS. 2*a-b*. In the non-compressed state $S_{NC}$, the ejection elements 1 are arranged as a protruding bodies extending in the pressing direction $D_P$ relative to surrounding surfaces 4 of the respective mould parts, as understood from the figures. The ejection elements 1 of the second mould part 3*b* are in the non-compressed state $S_{NC}$ extending out from the cavity 9 in the pressing direction $D_P$.

When the cellulose blank structure 2 has been arranged in the forming mould 3, the first mould part 3*a* is moved towards the second mould part 3*b* during the dry-forming process, as described above in connection to FIG. 2*b*. When the forming pressure $P_F$ is established in the forming mould 3 onto the cellulose blank structure 2, the movement of the first mould part 3*a* is stopped in the product forming position $F_{POS}$, in which the forming pressure $P_F$ is exerted onto the cellulose blank structure 2. The forming position $F_{POS}$ is schematically shown in FIG. 2*c*. The interaction between the first mould part 3*a* with and the second mould part 3*b* is thus establishing the forming pressure $P_F$ in the forming mould 3. The applied force is during the forming process establishing the forming pressure $P_F$ onto the cellulose blank structure 2, which together with the forming temperature $T_F$ applied onto the cellulose blank structure 2 is dry-forming the cellulose products P. In the forming position $F_{POS}$, the ejection elements are deformed from the non-compressed state $S_{NC}$ to the compressed state $S_C$. The ejection elements 1 of the second mould part 3*b* are deformed within the cavities 9 in the compressed state $S_C$, as shown in FIG. 2*c*.

Suitably, the forming pressure $P_F$ is applied onto the air-formed cellulose blank structure 2 during a single pressing operation $O_{SP}$ upon forming of the cellulose products P in the forming mould 3, where the cellulose product P is formed from the cellulose blank structure 2 in one single pressing step in the forming mould 3.

Figure 2D:
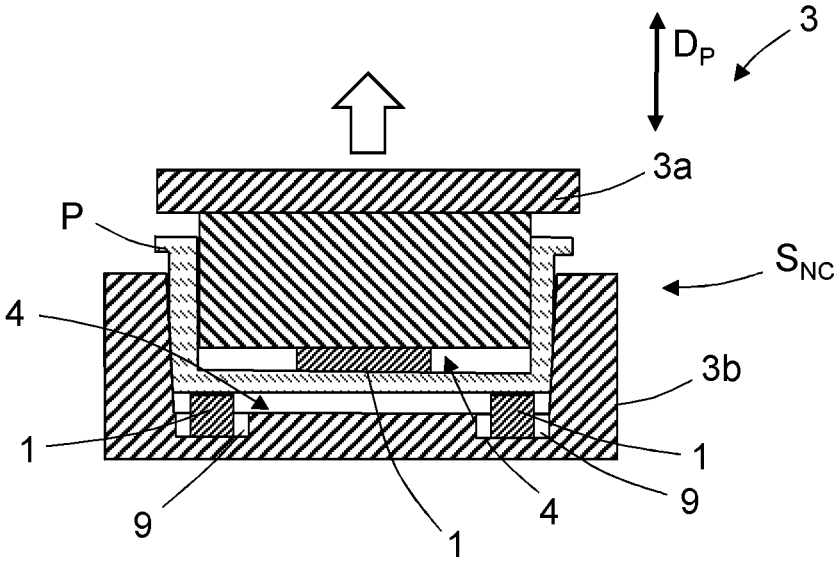
Figure 2E:
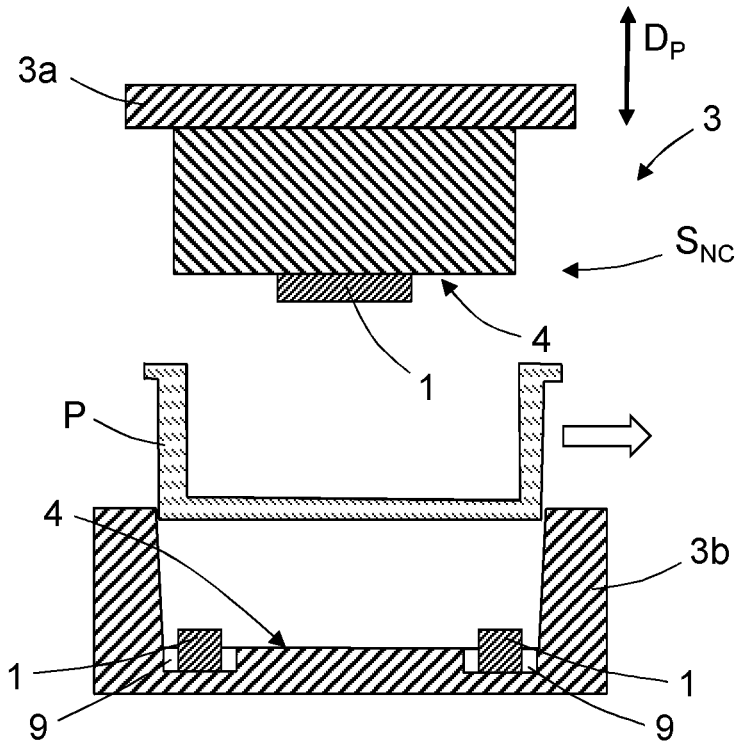

After dry-forming the cellulose products P in the forming position $F_{POS}$, as shown in FIG. 2*c*, the first mould part 3*a* is moved in a direction away from the second mould part 3*b*. During this movement, the ejection elements 1 are expanded from the compressed state $S_C$ back to the non-compressed state $S_{NC}$ after the forming of the cellulose products P in the forming mould 3, and through the expansion the ejection elements 1 the formed cellulose products P are separated from the respective mould parts, as shown in FIGS. 2*d-e*. The expansion of the ejection elements 1 from the compressed state $S_C$ back to the non-compressed state $S_{NC}$ is pushing the formed cellulose products P away from the mould parts. This is enabling an easy removal of the cellulose products P from the forming mould 3, as indicated with the arrow in FIG. 2*e*.

In other embodiments, the first mould part 3*a* and/or the second mould part 3*b* comprises a cutting edge 8 configured for cutting out the formed cellulose products P from the cellulose blank structure 2 upon forming of the cellulose products P in the forming mould 3, and at least one ejection element 1 is arranged in connection to the cutting edge 8. In this way, the formed cellulose products P and/or residual parts 2*a* of the cellulose blank structure 2 are separated from the forming mould 3 by the at least one ejection element 1 upon expansion of the at least one ejection element 1 from the compressed state $S_C$ to the non-compressed state $S_{NC}$ after the forming of the cellulose products P in the forming mould 3. The at least one ejection element 1 may be arranged on a lateral inner side $S_{LI}$ of the cutting edge 8 and configured for separating the formed cellulose products P from the forming mould 3 upon expansion of the at least one ejection element 1 from the compressed state $S_C$ to the non-compressed state $S_{NC}$. The at least one ejection element 1 may be arranged on a lateral outer side $S_{LO}$ of the cutting edge 8 and configured for separating residual parts 2*a* of the cellulose blank structure 2 from the forming mould 3 upon expansion of the at least one ejection element 1 from the compressed state $S_C$ to the non-compressed state $S_{NC}$.

A further alternative embodiment of the forming mould 3 is schematically illustrated in FIGS. 3*a-d*. In this embodiment, the first mould part 3*a* is illustrated with four ejection elements 1, and the second mould part 3*b* with one ejection element 1. However, the mould parts may be arranged with any suitable number of ejection elements 1. The ejection elements 1 are arranged as resilient protruding bodies extending in the pressing direction $D_P$ of the forming mould 3 relative to surrounding surfaces 4 of the forming mould 3 in the non-compressed state $S_{NC}$. The first mould part 3*a* comprises a cutting edge 8. The cutting edge 8 is arranged for cutting out the formed cellulose products P from the cellulose blank structure 2 during the forming operation, and the cutting edge 8 is suitably arranged with a shape corresponding to an outer peripheral shape of the cellulose products P. The ejection elements 1 of the first mould part 3 are arranged in connection to the cutting edge 8. Two illustrated lateral inner ejection elements $\mathbf{1}_{LI}$ are arranged on lateral inner sides $S_{LI}$ of the cutting edge 8. The lateral inner ejection elements $\mathbf{1}_{LI}$ are configured for separating the formed cellulose products P from the forming mould 3 upon expansion of the lateral inner ejection elements $\mathbf{1}_{LI}$ from the compressed state $S_C$ to the non-compressed state $S_{NC}$. Two illustrated lateral outer ejection elements $\mathbf{1}_{LO}$ are arranged on lateral outer sides $S_{LO}$ of the cutting edge 8. The lateral outer ejection elements $\mathbf{1}_{LO}$ are configured for separating residual parts 2*a* of the cellulose blank structure 2 from the forming mould 3 upon expansion of the lateral outer ejection elements $\mathbf{1}_{LO}$ from the compressed state $S_C$ to the non-compressed state $S_{NC}$.

Figure 3A:
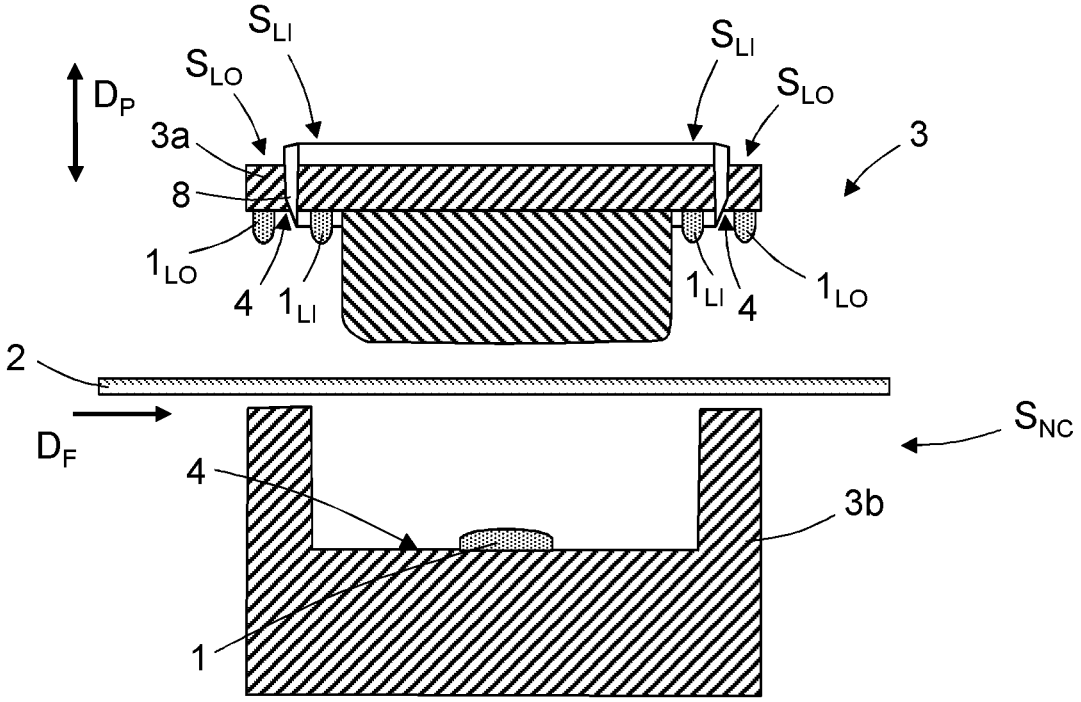
FIG. 3*a-d* show schematically, in side views, a forming mould with a cutting edge and ejection elements according to an alternative embodiment.

The operation of the forming mould 3 illustrated in FIGS. 3*a-d* is similar to the one in FIGS. 2*a-e*. The cellulose blank structure 2 is, as indicated in FIG. 3*a*, transported to the forming mould 3 in a feeding direction $D_F$. The cellulose blank structure 2 is suitably fed intermittently to the forming mould 3. In order to form the cellulose products P, the cellulose blank structure 2 is arranged between the first mould part 3*a* and the second mould part 3*b*, as shown in FIG. 3*a*.

Figure 3B:
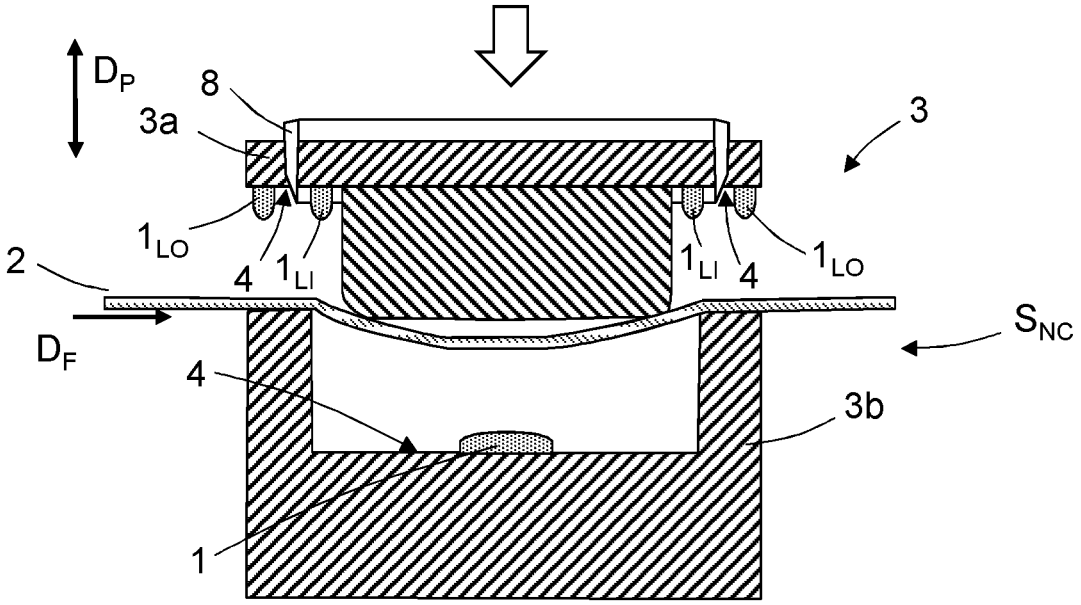

Upon forming of the cellulose products P, the first mould part 3*a* is moved towards the second mould part 3*b*, as shown in FIG. 3*b*, and in the illustrated embodiment, the cellulose blank structure 2 is pushed by the first mould part 3*a* into the second mould part 3*b*. When the first mould part 3*a* is pushed towards the second mould part 3*b* with the cellulose blank structure 2 positioned between the mould parts, the forming pressure $P_F$ is established onto the cellulose blank structure 2 by the pushing force applied by the first mould part 3*a*.

Before any forming pressure $P_F$ is exerted onto the cellulose blank structure 2, the ejection elements 1 are arranged in the non-compressed state $S_{NC}$, as schematically illustrated in FIGS. 3*a-b*. In the non-compressed state $S_{NC}$, the ejection elements 1 are arranged as protruding bodies extending in the pressing direction $D_P$ relative to surrounding surfaces 4 of the respective mould parts, as understood from the figures.

Figure 3C:
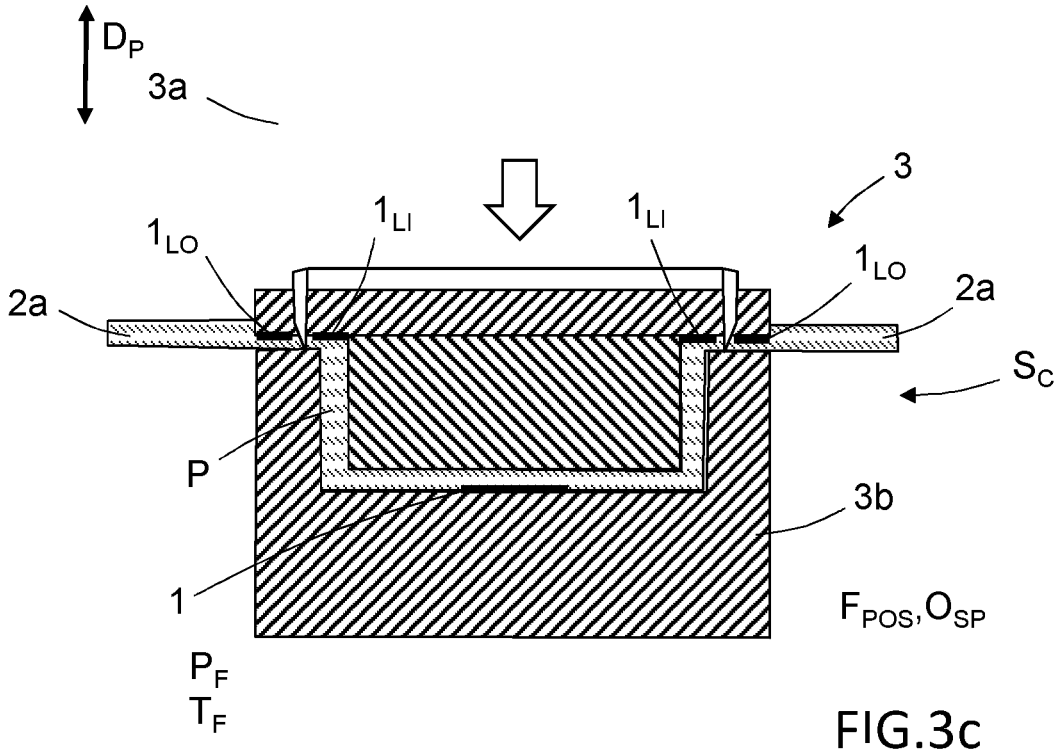
Figure 3D:
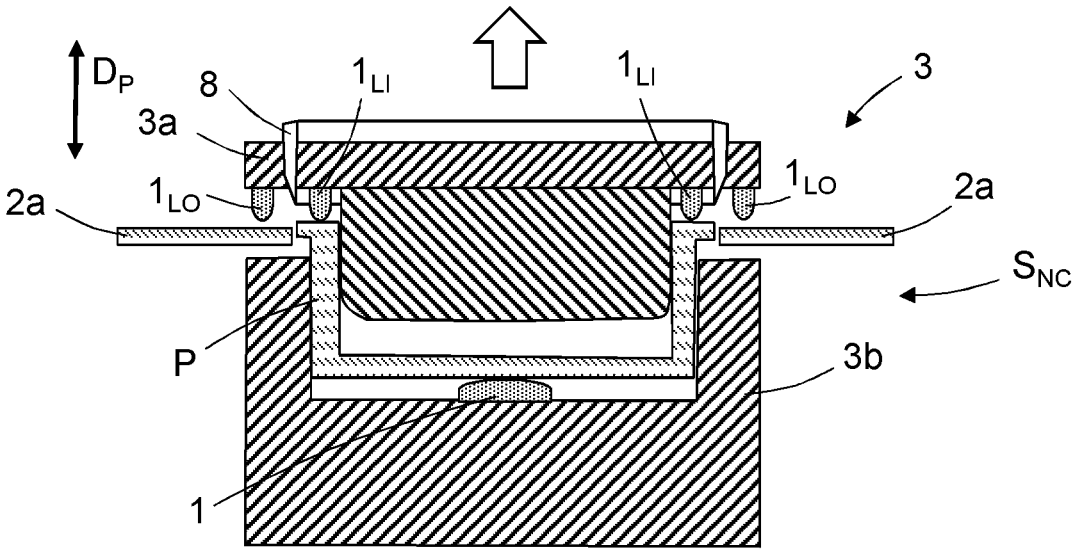

When the cellulose blank structure 2 has been arranged in the forming mould 3, the first mould part 3*a* is moved towards the second mould part 3*b* during the dry-forming process, as described above in connection to FIG. 3*b*. When the forming pressure $P_F$ is established in the forming mould 3 onto the cellulose blank structure 2, the movement of the first mould part 3*a* is stopped in the product forming position $F_{POS}$, in which the forming pressure $P_F$ is exerted onto the cellulose blank structure 2. The forming position $F_{POS}$ is schematically shown in FIG. 3*c*. The interaction between the first mould part 3*a* with and the second mould part 3*b* is thus establishing the forming pressure $P_F$ in the forming mould 3. The applied force is during the forming process establishing the forming pressure $P_F$ onto the cellulose blank structure 2, which together with the forming temperature $T_F$ applied onto the cellulose blank structure 2 is dry-forming the cellulose products P. In the forming position $F_{POS}$, the ejection elements 1 are deformed from the non-compressed state $S_{NC}$ to the compressed state $S_C$. Suitably, the cutting edge 8 is cutting out the formed cellulose products P from the cellulose blank structure 2 during the forming operation, as shown in FIG. 3*c*.

The forming pressure $P_F$ may be applied onto the air-formed cellulose blank structure 2 during a single pressing operation $O_{SP}$ upon forming of the cellulose products P in the forming mould 3, where the cellulose product P is formed from the cellulose blank structure 2 in one single pressing step in the forming mould 3.

After dry-forming the cellulose products P in the forming position $F_{POS}$, as shown in FIG. 3*c*, the first mould part 3*a* is moved in a direction away from the second mould part 3*b*. During this movement, the ejection elements 1 are expanded from the compressed state $S_C$ back to the non-compressed state $S_{NC}$ after the forming of the cellulose products P in the forming mould 3.

The ejection element 1 of the second mould part 3*b* is through the expansion from the compressed state $S_C$ to the non-compressed state $S_{NC}$ separating the formed cellulose products P from the second mould part 3*b* by pushing the cellulose products P in a direction away from the second mould part 3*b*. The formed cellulose products P are further separated from the first mould part 3*a* by the lateral inner ejection elements $\mathbf{1}_{LI}$ upon expansion from the compressed state $S_C$ to the non-compressed state $S_{NC}$.

The residual parts 2*a* of the cellulose blank structure 2 are separated from the first mould part 3*a* by the lateral outer ejection elements $\mathbf{1}_{LO}$ upon expansion from the compressed state $S_C$ to the non-compressed state $S_{NC}$. This is enabling an easy removal of the cellulose products P from the forming mould 3.

Figure 4A:
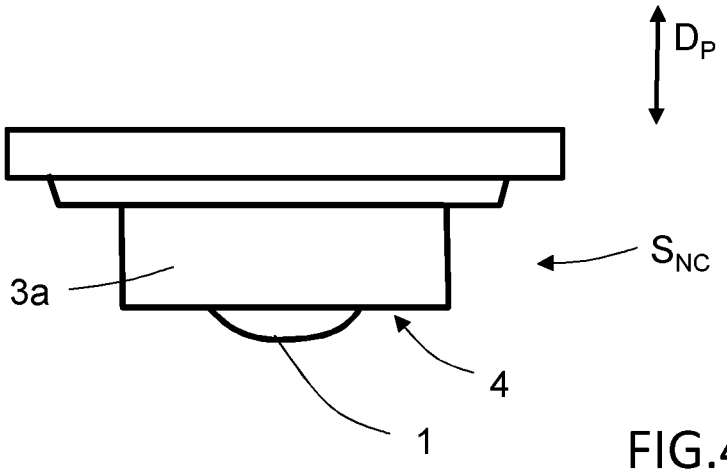
FIG. 4*a-b* show schematically, in a side view and in a view from below, a first mould part of the forming mould with an ejection element comprising an embossing pattern.
Figure 4B:
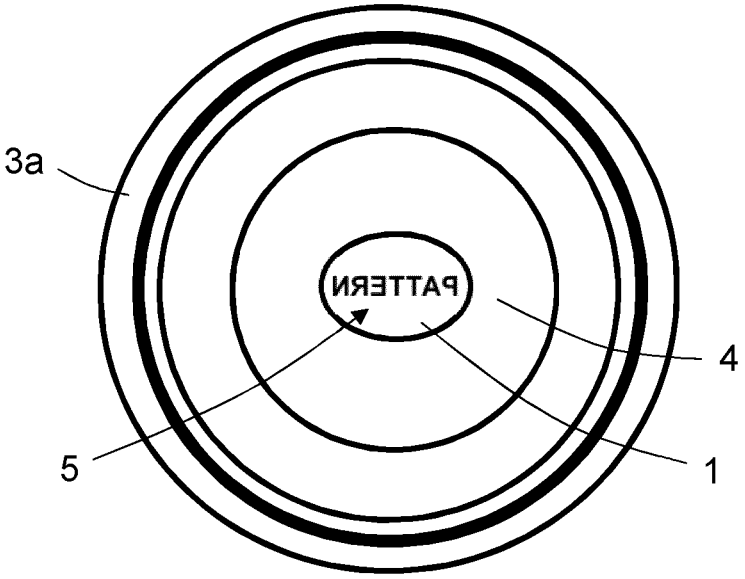
Figure 5A:
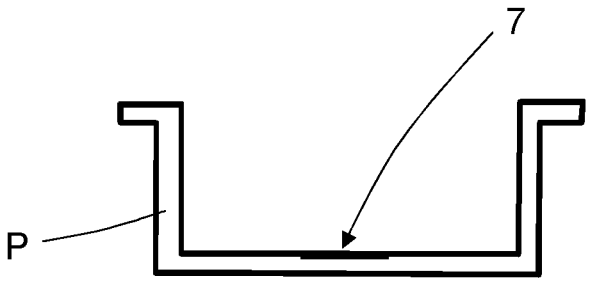
FIG. 5*a-b* show schematically in a side view and in a view from above, a cellulose product with a formed structural pattern.
Figure 5B:
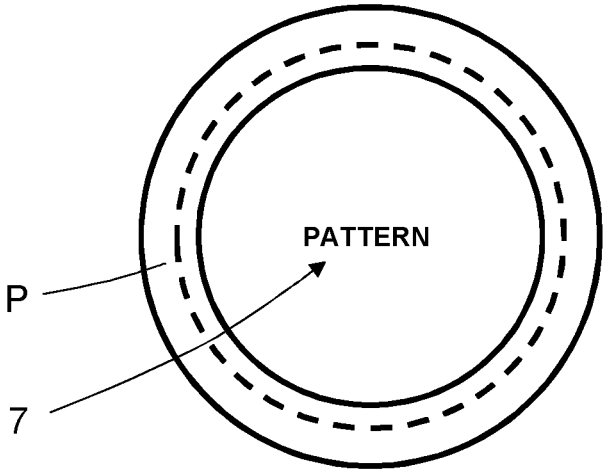

In another embodiment, as illustrated in FIGS. 4*a-b*, the ejection element 1 comprises an embossing pattern 5 configured for forming a structural pattern 7 in the cellulose products P upon forming in the forming mould 3. In the shown embodiment, the ejection element 1 is arranged on the first mould part 3*a* for illustrative purposes. In other non-illustrated embodiments at least one ejection element 1 with embossing pattern 5 may be arranged on the first mould part 3*a* and/or the second mould part 3*b*. The structural pattern 7 is arranged inside the cellulose product P as schematically illustrated in FIGS. 5*a-b*. The embossing pattern 5 is compressing the cellulose fibres in the cellulose blank structure 2 upon forming in the forming mould 3, and the compression of the cellulose fibres are forming the structural pattern 7. The embossing pattern 5 is suitably configured as a barcode, a QR code, or other identification code, or alternatively as a logotype. The ejection element 1 may have any suitable configuration.

Figure 6A:
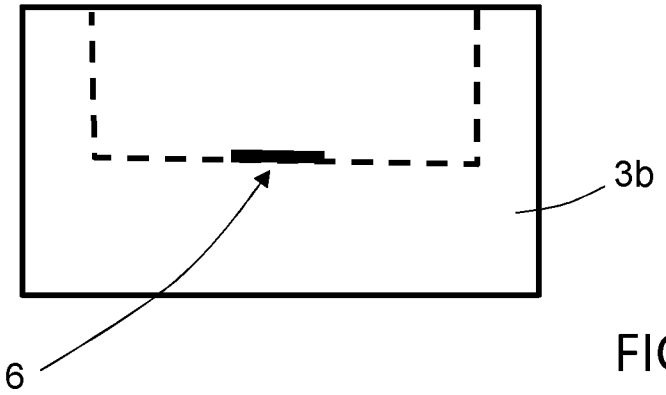
FIG. 6*a-b* show schematically, in a side view and in a view from above, a second mould part of the forming mould comprising a mould embossing pattern.
Figure 6B:
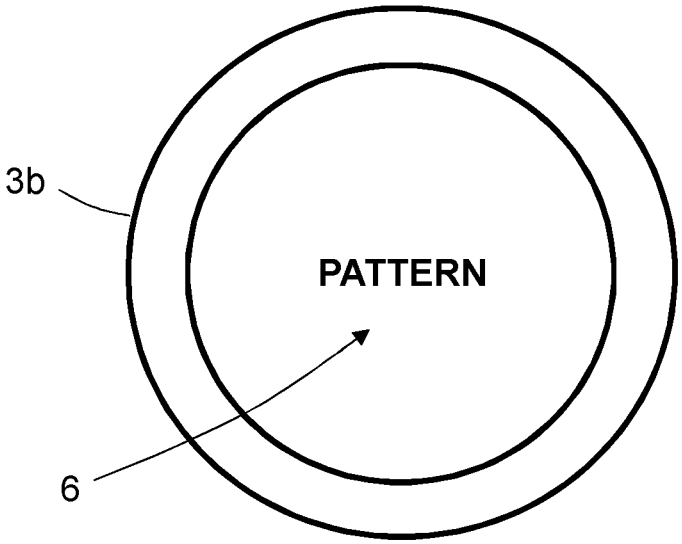
Figure 7A:
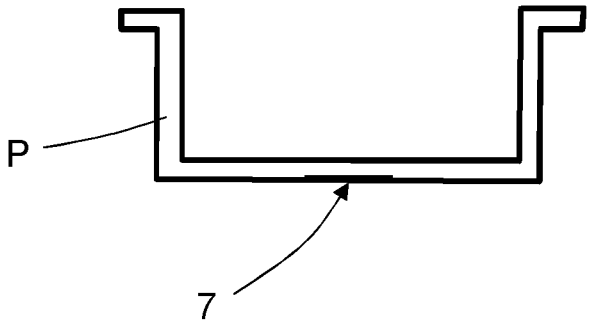
FIG. 7*a-b* show schematically in a side view and in a view from below, a cellulose product with a formed structural pattern.
Figure 7B:
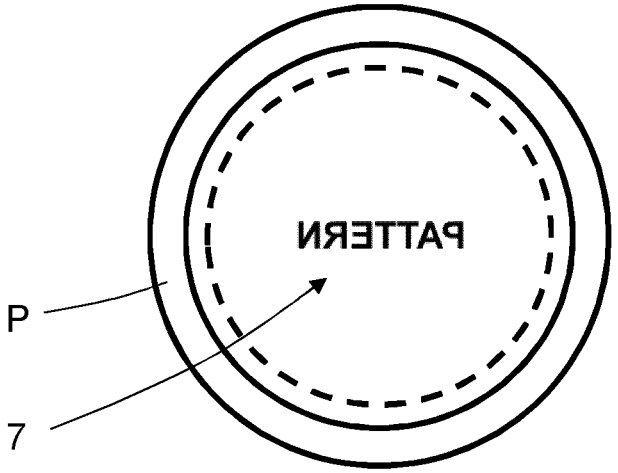

In another embodiment, as illustrated in FIGS. 6*a-b*, the second mould part 3*b* comprises a mould embossing pattern 6. The mould embossing pattern 6 is configured for forming the structural pattern 7 in the cellulose products P upon forming in the forming mould 3. The structural pattern 7 is arranged on the outside of the cellulose product P as schematically illustrated in FIGS. 7*a-b*. The mould embossing pattern 6 is compressing the cellulose fibres in the cellulose blank structure 2 upon forming in the forming mould 3, and the compression of the cellulose fibres are forming the structural pattern 7. The mould embossing pattern 6 is suitably configured as a barcode, a QR code, or other identification code, or alternatively as a logotype. In other embodiments, the embossing pattern 5 and the mould embossing pattern 6 may be arranged in the same forming mould 3 for forming the structural pattern 7 on different sides of the cellulose product P. It should be understood that in other non-illustrated embodiments one or more mould embossing patterns 6 may be arranged on the first mould part 3*a* and/or the second mould part 3*b*.

For all embodiments, the forming mould 3 suitably comprises a heating unit that is establishing the forming temperature $T_F$ in the cellulose blank structure 2. The heating unit may have any suitable configuration, and as an example, a heated mould part or heated mould parts may be used for establishing the forming temperature $T_F$. The heating unit may be integrated in or cast into the first mould part 3*a* and/or the second mould part 3*b*, and suitable heating devices are e.g. electrical heaters, such as a resistor element, or fluid heaters. Other suitable heat sources may also be used.

For all embodiments, the cellulose blank structure 2 may be arranged into the forming mould 3 in any suitable way, and as an example, the cellulose blank structure 2 may be fed with a suitable feeding device, which is transporting the cellulose blank structure 2 to the forming mould 3 in the feeding direction $D_F$. The feeding device could for example be a conveyor belt, a forming wire unit, an industrial robot, or any other suitable manufacturing equipment. The transportation speed may differ depending on the types of cellulose products P produced, and is chosen to match the forming speed in the forming mould 3.

FIGS. 5*a-b* and 7*a-b* schematically show three-dimensional cellulose products P formed from a compressed air-formed cellulose blank structure 2. The cellulose blank structure 2 comprises loose and separated cellulose fibres that are compressed upon forming of the cellulose product P. In the illustrated embodiments, the cellulose products P comprise a structural pattern 7 configured as a barcode, a QR code, or other identification code. As described above, with the expression loose and separated cellulose fibres is meant cellulose fibres that are separated from each other and loosely arranged relative to each other within the cellulose blank structure 2, or cellulose fibres or cellulose fibre bundles that are separated from each other and loosely arranged relative to each other within the cellulose blank structure 2.

As understood from FIGS. 4*a-b* and 5*a-b*, the structural pattern 7 is provided on an inside of the cellulose products P and is a result of the embossing pattern 5 in the ejection element 4 pressing against and forming the loose and separated fibres of the cellulose blank structure 2 into a rigid structure simultaneously with the forming of the cellulose products P.

As understood from FIGS. 6*a-b* and 7*a-b*, the structural pattern 7 is provided on an outside of the cellulose products P and is a result of the mould embossing pattern 6 in the second mould part 3*b* pressing against and forming the loose and separated fibres of the cellulose blank structure 2 into a rigid structure simultaneously with the forming of the cellulose products P.

Hence, the structural pattern 7 can be arranged on the inside of the cellulose products P or on the outside of the cellulose products P. However, according to one example embodiment, both the ejection element 1 and the opposite mould part may be provided with embossing pattern 5 and mould embossing pattern 6 giving a structural pattern on both the inside and the outside of the cellulose products P. The two structural patterns 7 can be either two different patterns or one pattern seen from either the inside or the outside of the cellulose products P. Two different patterns can for example be advantageously used to identify two different use modes of the final product. The first use mode could for example be used to identify product specific information from the outside before use, and the second use mode could for example be used to give product specific information after use. The product specific information in the first mode could, for example, give information on what the cellulose products contains, such as a table of contents. The product specific information in the second mode could for example give information on how the cellulose products should be recycled. The structural pattern or patterns are advantageously formed such that a non-illustrated reading unit can identify the pattern and provide adequate information from for example a database to a user of the cellulose product P, or alternatively to a sorting unit or the like. The reading unit may for example be a cellular phone with a suitable sensor equipment, a handheld reader with a suitable sensor equipment, or an automized machine with a suitable sensor equipment. The suitable sensor equipment can for example be a camera connected to an image decoding device and/or a therefor adapted software for signal processing. The suitable sensor equipment can for example be a light unit connected to a frequency decoding device and/or a therefor adapted software for signal processing.

It will be appreciated that the above description is merely exemplary in nature and is not intended to limit the present disclosure, its application or uses. While specific examples have been described in the specification and illustrated in the drawings, it will be understood by those of ordinary skill in the art that various changes may be made and equivalents may be substituted for elements thereof without departing from the scope of the present disclosure as defined in the claims. Furthermore, modifications may be made to adapt a particular situation or material to the teachings of the present disclosure without departing from the essential scope thereof. Therefore, it is intended that the present disclosure not be limited to the particular examples illustrated by the drawings and described in the specification as the best mode presently contemplated for carrying out the teachings of the present disclosure, but that the scope of the present disclosure will include any embodiments falling within the foregoing description and the appended claims. Reference signs mentioned in the claims should not be seen as limiting the extent of the matter protected by the claims, and their sole function is to make claims easier to understand.

REFERENCE SIGNS

1: Ejection element
2: Cellulose blank structure
2*a*: Residual part
3: Forming mould
3*a*: First mould part
3*b*: Second mould part
4: Surrounding surface
5: Embossing pattern
6: Mould embossing pattern
7: Structural pattern
8: Cutting edge
9: Cavity
$D_P$: Pressing direction
$F_{POS}$: Forming position
$O_{SP}$: Single pressing operation
P: Cellulose product
$P_F$: Forming pressure
PM: Pressing module
$S_C$: Compressed state
$S_{NC}$: Non-compressed state
$S_{LI}$: Lateral inner side
$S_{LO}$: Lateral outer side
$T_F$: Forming temperature

The invention claimed is:

1. A forming mould for forming three-dimensional cellulose products from an air-formed cellulose blank structure, wherein the forming mould comprises at least one ejection element arranged for ejecting the cellulose products and/or residual parts of the cellulose blank structure from the forming mould after forming of the cellulose products in the forming mould, wherein the at least one ejection element is arranged as a resilient protruding body extending in a pressing direction of the forming mould relative to a surrounding surface of the forming mould in a non-compressed state, wherein the at least one ejection element is configured for separating the formed cellulose products and/or residual parts of the cellulose blank structure from the forming mould upon expansion of the at least one ejection element from a compressed state to the non-compressed state after the forming of the cellulose products in the forming mould, wherein the forming mould comprises a first mould part and a second mould part, wherein the first mould part and the second mould part are movable relative to each other in the pressing direction and arranged to be pressed in relation to each other during forming of the cellulose products, wherein the at least one ejection element is attached to the first mould part and/or the second mould part, wherein the at least one ejection element is arranged in a cavity in the first mould part and/or the second mould part, wherein the at least one ejection element in the non-compressed state (SNC) is extending out from the cavity in the pressing direction, wherein the ejection element is configured for being deformed within the cavity in the compressed state.

2. The forming mould according to claim 1, wherein the at least one ejection element is attached to the forming mould.

3. The forming mould according to claim 1, wherein the first mould part and/or the second mould part comprises a cutting edge configured for cutting out the formed cellulose products from the cellulose blank structure upon forming of the cellulose products in the forming mould, wherein the at least one ejection element is arranged in connection to the cutting edge.

4. The forming mould according to claim 3, wherein the at least one ejection element is arranged on a lateral inner side of the cutting edge and configured for separating the formed cellulose products from the forming mould upon expansion of the at least one ejection element from the compressed state to the non-compressed state.

5. The forming mould according to claim 3, wherein the at least one ejection element is arranged on a lateral outer side of the cutting edge and configured for separating residual parts of the cellulose blank structure from the forming mould upon expansion of the at least one ejection element from the compressed state to the non-compressed state.

6. The forming mould according to claim 1, wherein the at least one ejection element comprises an embossing pattern and/or wherein the first mould part and/or the second mould part comprises a mould embossing pattern, wherein the embossing pattern and/or mould embossing pattern is configured for forming a structural pattern in the cellulose products upon forming in the forming mould.

7. The forming mould according to claim 6, wherein the embossing pattern and/or the mould embossing pattern is configured as a logotype, a barcode, a QR code, or other identification code.

8. A method for forming three-dimensional cellulose products from an air-formed cellulose blank structure in a forming mould, wherein the forming mould comprises at least one ejection element, wherein the at least one ejection element is arranged for ejecting the cellulose products and/or residual parts of the cellulose blank structure from the forming mould after forming of the cellulose products in the forming mould, wherein the at least one ejection element is arranged as a resilient protruding body extending in a pressing direction of the forming mould relative to a surrounding surface of the forming mould in a non-compressed state, wherein the method comprises the steps:

separating the formed cellulose products and/or residual parts of the cellulose blank structure from the forming mould by the at least one ejection element upon expansion of the at least one ejection element from a compressed state to the non-compressed state after the forming of the cellulose products in the forming mould, wherein the forming mould comprises a first mould part and a second mould part, wherein the first mould part and the second mould part are movable relative to each other in the pressing direction and arranged to be pressed in relation to each other during forming of the cellulose products, wherein the at least one ejection element is attached to the first mould part and/or the second mould part, wherein the method further comprises the steps: separating the formed cellulose products and/or residual parts of the cellulose blank structure from the first mould part and/or the second mould part by the at least one ejection element upon expansion of the at least one ejection element from the compressed state to the non-compressed state after the forming of the cellulose products in the forming mould, wherein the at least one ejection element is arranged in a cavity in the first mould part and/or the second mould part, wherein the at least one ejection element in the non-compressed state is extending out from the cavity in the pressing direction, wherein the method further comprises the step: deforming the ejection element within the cavity in the compressed state.

9. The method according to claim 8, wherein the at least one ejection element comprises an embossing pattern and/or wherein the first mould part and/or the second mould part comprises a mould embossing pattern, wherein the method further comprises the step: forming a structural pattern in the cellulose products with the embossing pattern and/or the mould embossing pattern upon forming in the forming mould.

10. The method according to claim 9, wherein the embossing pattern and/or the mould embossing pattern is configured as a logotype, a barcode, a QR code, or other identification code.

11. The method according to claim 8, wherein the first mould part and/or the second mould part comprises a cutting edge configured for cutting out the formed cellulose products from the cellulose blank structure upon forming of the cellulose products in the forming mould, wherein the at least one ejection element is arranged in connection to the cutting edge on a lateral inner side of the cutting edge, wherein the method further comprises the step: separating the formed cellulose products from the forming mould by the at least one ejection element upon expansion of the at least one ejection element from the compressed state to the non-compressed state.

12. The method according to claim 8, wherein the first mould part and/or the second mould part comprises a cutting edge configured for cutting out the formed cellulose products from the cellulose blank structure upon forming of the cellulose products in the forming mould, wherein the at least one ejection element is arranged in connection to the cutting edge on a lateral outer side of the cutting edge, wherein the method further comprises the step: separating residual parts of the cellulose blank structure from the forming mould by the at least one ejection element upon expansion of the at least one ejection element from the compressed state to the non-compressed state.

* * * * *